US005289961A

United States Patent [19]

Levitt et al.

[11] Patent Number: 5,289,961

[45] Date of Patent: Mar. 1, 1994

[54] DEVICE FOR HOLDING WRITING INSTRUMENTS

[76] Inventors: Michael Levitt, 34-05 Woodward St.; Grigory Gelman, 33-29 Poplar St., both of Oceanside, N.Y. 11572

[21] Appl. No.: 838,025

[22] Filed: Feb. 20, 1992

[51] Int. Cl.[5] ..... A45F 5/00

[52] U.S. Cl. ..... 224/247; 224/219; 224/222; 224/269

[58] Field of Search ..... 224/217, 218, 219, 222, 224/224, 230, 231, 232, 233, 247, 248, 268, 267, 269, 271, 904; 2/251, 250, 249, 254, 268; 450/86; 24/6, 10 R, 11 CC, 11 HC, 11 S

[56] References Cited

U.S. PATENT DOCUMENTS

| | | | |
|---|---|---|---|
| 1,274,312 | 7/1918 | Nicoll | 224/222 |
| 1,833,222 | 11/1931 | Lischeid | 224/230 X |
| 3,273,766 | 9/1966 | Cosentino | 224/219 X |
| 3,401,529 | 9/1968 | Fifield | 224/247 X |
| 5,056,661 | 10/1991 | Balzano | 224/247 X |

*Primary Examiner*—Glenn J. Barrett
*Attorney, Agent, or Firm*—I. Zhorovsky

[57] ABSTRACT

A device for holding writing instruments has a supporting member, a plurality of holding members arranged on the supporting member and each having a receptacle for receiving a writing instrument, and a retainer to retain the supporting member on a part of body or clothes.

10 Claims, 2 Drawing Sheets

DEVICE FOR HOLDING WRITING INSTRUMENTS

BACKGROUND OF THE INVENTION

The present invention relates to a device for holding writing instruments, in particular during performing some works which require movements of a user which can result in falling out of writing instruments.

During performing some works, for example construction, repair, etc. a worker moves to respective positions to performs respective steps of the works. Writing instruments, such as pencils, pens, markers and the like are usually held in a pocket, behind his ear, in his hair, etc. During the above specified movements they can fall out and get lost or must be again located and put back with corresponding waste of time. It is therefore believed to be clear that it is desirable to develop a way to reliably retain writing instruments on a part of body or clothes of a worker, so that during performance of works they do not fall out in unauthorized manner but at the same time can be easily removed by a user to be used for respective operations.

SUMMARY OF THE INVENTION

Accordingly, it is an object of the present invention to provide a device for holding writing instruments which can hold writing instruments so that their unauthorized falling out is prevented and at the same time they can be easily removed from the device for respective operations.

In keeping with these objects and with others which will become apparent hereinafter, one feature of the present invention resides, briefly stated, in a device for holding writing instruments, which has an elongated supporting member, a plurality of holding members supported on the supporting member and each having a receptacle for receiving and holding a writing instrument in an elastic manner, and means for retaining the supporting member on a part of body or clothes of a user.

When the device is designed in accordance with the present invention, it achieves the above specified objects in reliably holding the writing instruments with simultaneously allowing their easy withdrawal from the deivice for respective operations.

The holding members can be of one piece with the supporting member or formed as separate members connectable with the supporting member. In the latter case the supporting member can be provided with spacing and retaining projections for the holding members.

Each receptacle of the holding member can have an inner part for retaining a writing instrument and a narrower outer part for introducing the writing instrument into the inner part. The outer part can have surfaces inclined inwardly or outwardly, and can be limited by elastic yieldable shoulders to allow passage of the writing instrument through the outer part and thereafter springing back of the shoulders to partially close the inner part of the receptacle with the writing instrument in it.

The means for retaining of the supporting member on a part of body or clothes of a user can include an adjustable belt member, an elastic elongated member, a member with a plurality of projections for engaging with the part of body or clothes of a user and attachable to the supporting member for example by adhesive.

The retaining members can be provided with openings for fitting on the supporting member. The openings can extend substantially transversely to the receptacles and formed as slots elongated along the receptacles. The receptacles in different holding members can have different sizes to receive and retain writing instruments of different sizes and/or shapes.

The novel features of the present invention are set forth in particular in the appended claims. The invention itself, however, both as to its construction and its manner of operation will be best understood from the following description of preferred embodiments which is accompanied by the following drawings.

DESCRIPTION OF PREFERRED EMBODIMENTS

Figure 1:
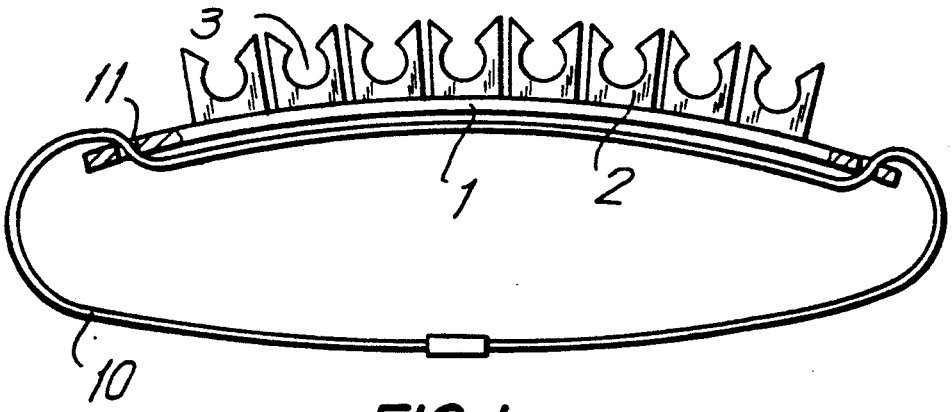
FIG 1 is a side view showing a device for holding writing instruments in accordance with the present invention.
Figure 2:
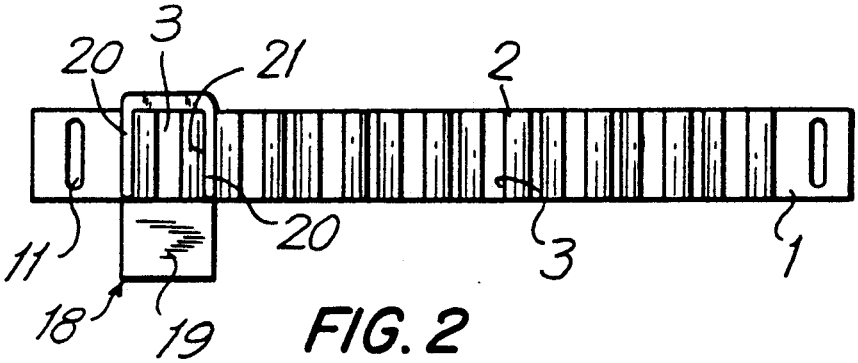
FIG. 2 is a plan view of the device in accordance with the invention.
Figure 3:
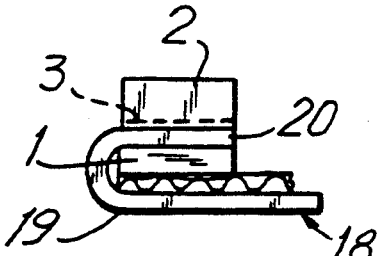
FIG. 3 is an end view of the device in accordance with the invention.

A device for holding writing instruments in accordance with the present invention has a supporting member which is identified with reference numeral 1 and a plurality of holding members which are supported by the supporting member and identified as 2. The supporting member 1 and the holding members 2 can be formed integrally of one piece with one another so as to form an integral element as shown in FIGS. 1–3. Each holding member 2 has a receptacle 3. The receptacle 3 extends in a direction which is transverse to the direction of elongation of the supporting member.

Each receptacle has an inner part for receiving and holding a writing instrument and an outer part for introducing the writing instrument into the inner part. The inner and outer parts are identified as 5 and 6. The outer part is narrower than the inner part and is formed by shoulders 7 provided in the holding member. The shoulders 7 are yieldable so that when a writing instrument is introduced through the outer part the shoulders are spread apart with overcoming their resistance and then spring back to return the outer part to its narrow size and to thereby reliably retain the writing instrument to prevent its unauthorized withdrawal. At the same time a user can easily remove the writing instrument by pulling it out and overcoming the resistance of the shoulders. As can be seen from FIG. 1, the distances between the holding elements 2 are smaller than the width of the outer part 6 of the receptacles.

Figure 4:
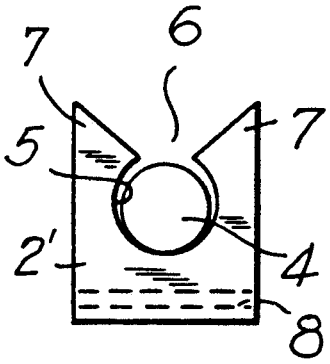
FIGS. 4 and 5 are a side view and an end view of a holding member of the inventive device.
Figure 5:
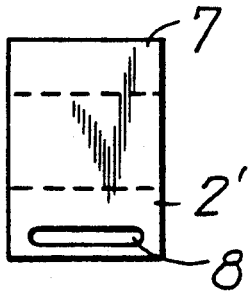
Figure 6:
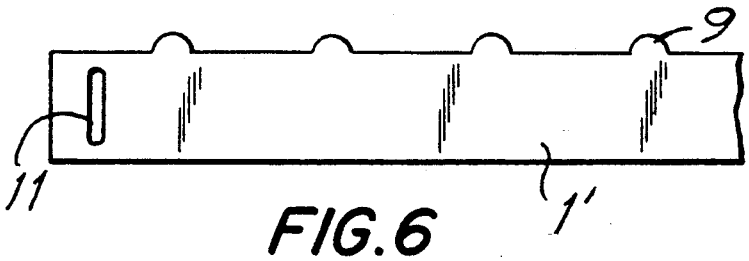
FIG. 6 is a view showing a supporting member of the device of the invention.

In the embodiment of FIGS. 4–6 a supporting member 1' and holding members 2' are formed as separate elements. Each holding member has an opening 8 which extends substantially transversely to the receptacle 3 and formed as a slot which is elongated in the direction of the receptacle. By the slots, the holding members can be fitted on the supporting member 1' one after the other. The supporting member 1' is provided with a plurality of spacing formations 9 which are elastically yieldable. During fitting of the holding members 2' they overcome a resistance of the formations (projections) 9, then the formations spring back and retain the holding members at their locations to prevent their unauthorized displacement along the supporting member The yieldability of the shoulders 7 and the formations 9 is achieved by forming them or the whole members 2 and 1' respectfully of an elastically yieldable material, for example plastic material. As can be seen from FIG. 4, the outer part 6 of the receptacles has inwardly inclined surfaces.

Figure 7:
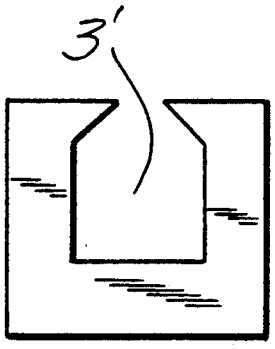
FIGS. 7 and 8 are views showing further modifications of the holding members of the inventive device.
Figure 8:
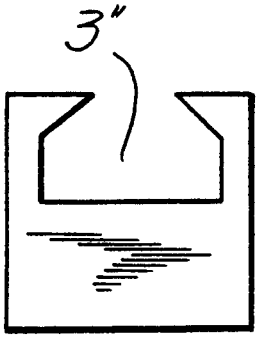

In practice there is a need to hold writing instruments of different sizes and/or shapes, for example pencils, pens, markers, etc. For this purpose the holding elements can have differently sized and/or shaped receptacles 3' and 3" as shown in FIGS. 7 and 8.

In order to retain the device on a part of body or clothes, retaining means is provided. The retaining means can be formed as an adjustable belt 10 extending through end slots 11 of the supporting member and adjustable due to the provision of a plurality of openings spaced in its direction of elongation and cooperating with a buckle, as well known. The retaining means can be formed as an elastic member which is stretcheable to adapt to the size of the body part over which the supporting member and the retaining member are fitted.

Figure 9:
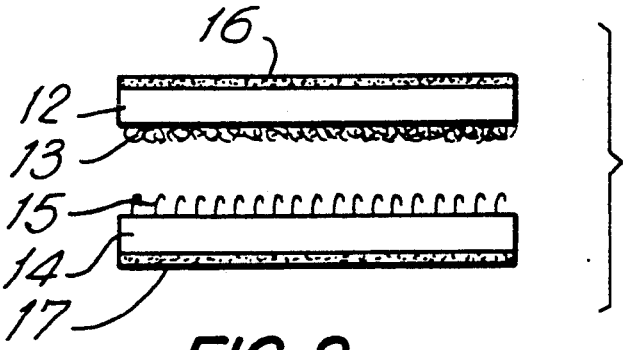
FIG. 9 is a view showing a member for retaining the device on a part of body or clothes.

Retaining means of a different construction is shown in FIG. 9. It has a member 12 attacheable to a part of the clothes and having projections 13 and a member 14 attacheable to the supporting member 1 and having engaging projections 15 engageable with the engaging projections 13. The member 12 can be attached to the clothes part by an adhesive layer 17 while the member 14 can be attached to the supporting member by an adhesive layer 17. The projections can be hook and loop type as well known.

Finally, the retaining means can be formed as a clip or clasp 18 provided with one leg 19, another shorter leg 20 elastically connected with the leg 19 and provided with a slot 21. The clip 18 can be fitted on the supporting member 1 so that one holding member is received and clamped elastically between the legs 19 and 20, while a piece of clothes is received between the legs 19 and 20, so that the clip is reliably held on the piece and holds the device on it.

The supporting member 1,1' can be rigid, or it can be elastic and flexible. All parts can be composed of plastic. The outer part of the receptacle 3 can narrow outwardly as shown in FIGS. 7 and 8, or inwardly as shown in FIG. 4. In the latter case the outer part 6 is formed as an inlet cone which guides a writing instrument to slide into the inner part 5 of the receptacle.

The present invention is not limited to the details shown since various modifications and structural changes are possible without departing in any way from the spirit of the invention.

What is desired to be protected by Letters Patent is set forth in the appended claims.

We claim:

1. A device for holding writing instruments, comprising an elongated supporting member having a predetermined direction of elongation;

and a plurality of holding members arranged on said supporting member substantially side by side along the direction of elongation of said supporting member and each having at least one receptacle for receiving at least one writing instrument, each of said receptacles having an inner part which substantially receives a writing instrument and an outer outwardly open part for introducing the writing instrument into said inner part, said holding members being spaced from one another by a distance which is smaller than said outer part of each of said receptacles as considered in direction of elongation of said supporting member so that a writing instrument can be inserted into said receptacles but cannot be inserted into a space between said holding members, each of said holding members having two straight sides which extend from said supporting member perpendicularly to said supporting member and have free ends, two inclined surfaces extending from said free ends of said straight sides inwardly and toward one another and having inner ends, and a partially circular surface which has ends connected with said inner ends of said inclined surfaces, so that in a region where said ends of said partially circular surface are connected with said inner ends of said inclined surfaces thickened walls are formed in each of said holding members so as to form two inner shoulders; and means for retaining said supporting member on at least one of a part of user's body and a part of user's clothes.

2. A device as defined in claim 1, wherein said holding members and said supporting member are formed together as one piece element.

3. A device as defined in claim 1, wherein said outer part of said receptacle is formed so that it narrows in direction from outside toward said inner part of said receptacle.

4. A device as defined in claim 1, wherein said means for retaining said supporting member on a part includes an adjustable belt member adapted to be put on a part and having a length adjustable to the part.

5. A device as defined in claim 1, wherein said means for retaining said supporting member on a part includes an elastic stretcheable retaining element connectable with said supporting member and adapted to be put on a part so as to retain said supporting member on the part.

6. A device as defined in claim 1, wherein said means for retaining said supporting member on a part includes a clip attacheable to said supporting member and holdable on the part by clamping over the part.

7. A device as defined in claim 1, wherein said means for retaining includes a clip having two legs spaced from one another to receive a part of clothes therebetween, one of said legs having a slot for receiving one of said holding members when said supporting member is also received between said legs.

8. A device as defined in claim 1, wherein said supporting member and said holding members are formed as a single one-piece element composed of plastic and provided with a plurality of slots spaced from one another in said direction of elongation, each of said slots having a width which is sufficiently great so that said element is elastic and at the same time sufficiently small so that it is smaller than a width of said outer part of said receptacles.

9. A device as defined in claim 8, wherein a portion of said outer part adjacent said inner part of said receptacle is narrower than said inner part.

10. A device as defined in claim 9, wherein said holding member has two shoulder portions, said shoulder portions being yieldable so that the writing instrument can be introduced through said outer part into said inner part with overcoming a resistance of said shoulders and spreading them apart, and thereafter said shoulders spring back to reliably prevent an unauthorized withdrawal of the writing instrument from said receptacle.

* * * * *